United States Patent [19]

Becker

[11] Patent Number: 5,045,145

[45] Date of Patent: Sep. 3, 1991

[54] MEANS FOR SUPPLYING A LABEL STRIP

[75] Inventor: Werner Becker, Hirschhorn, Fed. Rep. of Germany

[73] Assignee: Esselte Meto International Produktions GmbH, Hirschhorn, Fed. Rep. of Germany

[21] Appl. No.: 452,345

[22] Filed: Dec. 19, 1989

[30] Foreign Application Priority Data

Dec. 21, 1988 [DE] Fed. Rep. of Germany ..... 3843068

[51] Int. Cl.[5] ..... B65C 11/02

[52] U.S. Cl. ..... 156/384; 156/577; 156/579; 156/584; 226/76; 226/83; 101/288

[58] Field of Search ..... 156/384, 577, 579, 584, 156/523, 574, 540, 541; 226/76, 77, 82, 83; 101/288

[56] References Cited

U.S. PATENT DOCUMENTS

| | | | |
|---|---|---|---|
| 3,611,929 | 8/1969 | Neto | 101/292 |
| 4,033,494 | 7/1977 | Middleton et al. | 226/83 |
| 4,176,603 | 12/1979 | Sato | 156/384 X |
| 4,257,326 | 3/1981 | Sato | 101/288 |
| 4,384,525 | 5/1983 | Sato et al. | 101/288 |
| 4,452,667 | 6/1984 | Chang | 156/577 X |
| 4,560,087 | 12/1985 | Sato et al. | 156/384 X |
| 4,591,404 | 5/1986 | Hamisch, Jr. | 156/384 |
| 4,699,685 | 10/1987 | Sato | 156/384 |
| 4,851,076 | 7/1989 | Manusch et al. | 156/579 X |

OTHER PUBLICATIONS

German Federal Patent Court Decision dated Jul. 6, 1983.

*Primary Examiner*—William A. Powell
*Assistant Examiner*—J. Sells
*Attorney, Agent, or Firm*—Sixbey, Friedman, Leedom & Ferguson

[57] ABSTRACT

A means is described with the aid of which a label strip can be introduced into a label printing and/or label dispensing apparatus (10). The label printing and/or label dispensing apparatus (10) includes a transport wheel (38) which is surrounded by a cover (35). The label strip (25) must be introduced into the gap between the periphery of the transport wheel (38) and the cover (35). The distance between the inner surface of the cover (35) and the transport wheel (38) is dimensioned in a first region so that only a frictional force is exerted on the strip when the transport wheel (38) moves so that frictional entrainment of the label strip (25) results. In a second region, directly following the first region, the distance is so great that no deformation takes place between the label strip (25) and the transport wheel (38), and in a third region adjoining the second region the distance is so dimensioned that driver teeth (39) disposed on the periphery of the transport wheel (38) penetrate through the label strip (25) so that a form-locking engagement results.

3 Claims, 2 Drawing Sheets

MEANS FOR SUPPLYING A LABEL STRIP

Figure 1:
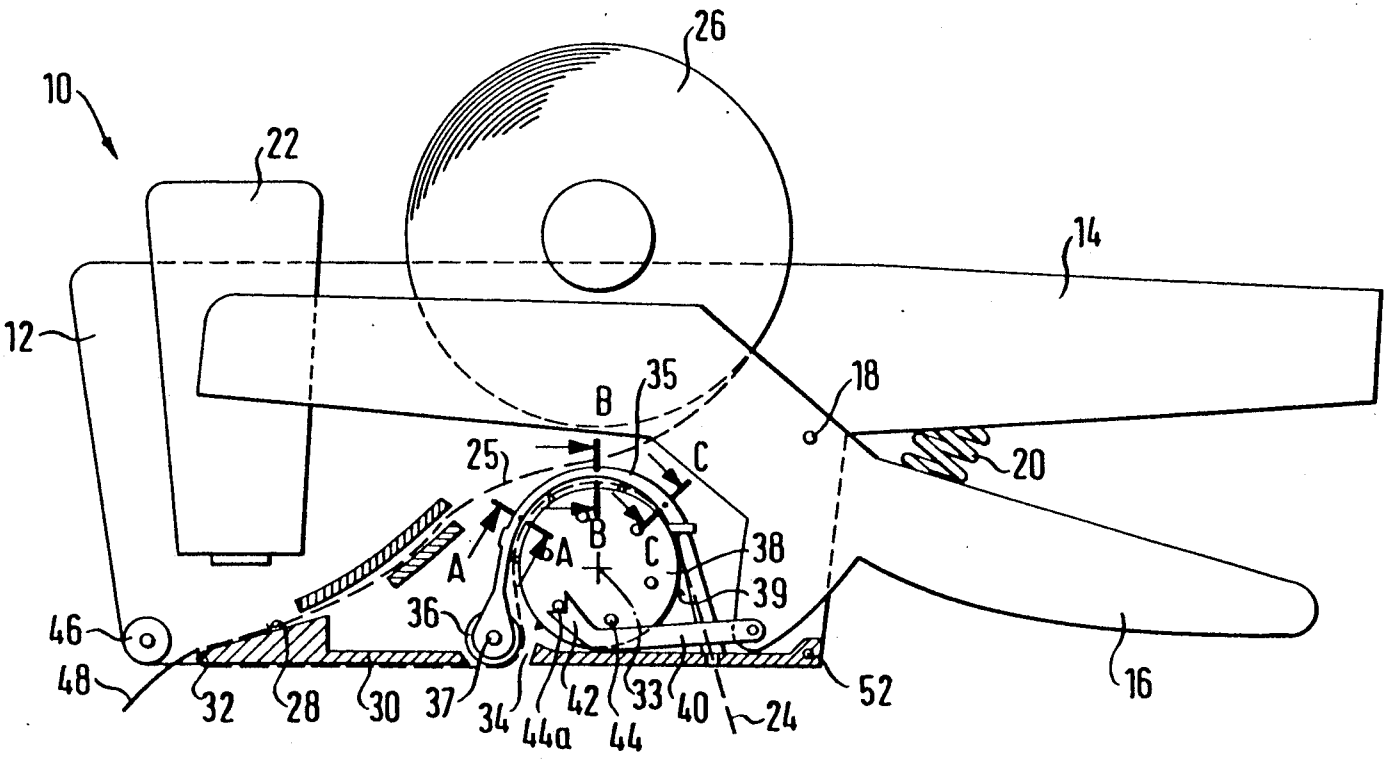

The invention relates to a means for supplying a label strip to the peripheral face of a transport wheel which is provided with radially projecting driver teeth, mounted on a label printing and label dispensing apparatus, rotatably mounted about an axis and engages the label strip by penetration of the driver teeth into transport cuts in the label strip and transports said strip from an entrance point to an exit point in each case through a distance equal to the length of the labels, the pitch of the driver teeth in the peripheral direction of the transport wheel being slightly greater than the pitch of the transport cuts in the label strip in the longitudinal direction thereof, the transport wheel being surrounded between the entrance point and the exit point by a cover which extends in the peripheral direction of the transport wheel and which in its inner face associated with the path along which the driver teeth move on rotation of a transport wheel is provided with at least one groove.

A means according to this type is described in DE-OS 2 646 355. The means is mounted in a labelling apparatus with the aid of which self-adhering labels stuck to a carrier strip can be imprinted, detached from the carrier strip and applied to an article. Labelling machines of this type are used widely in supermarkets or the like for marking prices of the articles to be sold.

The labelling apparatus described in DE-OS 3,440,000 comprises an operating lever which for carrying out an operating cycle in each case is pulled against the force of a spring against a grip and then released again. The spring moves the operating lever back into the starting position. In the course of an operating cycle a self-adhering label disposed on the label strip is imprinted, then detached from the carrier strip by transporting the label strip through one label length and deflection of the carrier strip about a dispensing edge so that said label can be applied to an article. The advancing of the label strip through a label length is by means of a transport wheel about which the carrier strip is led after detaching the self-adhering labels and which is rotated by the operating lever on return of the latter to the rest position about a predetermined angle which is so dimensioned that it effects precisely a movement of the label strip through one label length. In order to ensure that after each transport step at the location at which the imprinting of the label takes place the label to be imprinted assumes in each case the same printing position as the previously imprinted label transport cuts or incisions are formed in the label strip and the driver teeth at the peripheral face of the transport wheel engage into said cuts.

For inserting a label strip into the labelling apparatus the strips must be led round the transport wheel and the engagement of the driver teeth into the transport cuts established so that thereafter the strip can be stepwise advanced. To facilitate leading the label strip round the transport wheel in the known labelling apparatus a cover is provided which extends between the entrance point and the exit point and on the side of the transport wheel facing the apparatus interior defines a guide gap round the transport wheel. For inserting the strip into the apparatus the strip end is inserted into an introduction slot open at the apparatus lower side and several operating cycles are then carried out in the course of which the strip is led round the transport wheel until it emerges from the apparatus again at an exit point.

Since the labelling apparatus is actuated by hand it must be ensured that the force necessary for pulling the operating lever is not excessively large. This force is defined by the spring already mentioned which must be strong enough to return the operating lever after release back to the rest position and simultaneously with this return also permit actuation of the strip transport by means of the transport wheel. The greater the force to be applied for the transport the stronger said spring has to be made as well. Of course, the force of the spring should be as small as possible so that the operator of the labelling machine does not have to apply an excessive force to actuate the apparatus. On the other hand, however, a relatively large force is necessary to further transport the label strip through one step in each case, this being all the more true the wider the labels and the stiffer the material of the labels and of the carrier strip.

In particular in the introduction of the label strip into the slot between the cover and the peripheral face of the transport wheel, the matching of the transport force to be applied by the spring, the admissible stiffness of the label strips and the gap between the cover and the periphery of the transport wheel proves to be very problematical. If the gap is too narrow then the label strip is greatly deformed by the driver teeth directly on initial introduction into the gap and this leads to a great increase in the transport force to be applied; this increase can be so large that the spring no longer has available the force necessary for a complete transport step and this means that a complete operating cycle can no longer be carried out. On the other hand, between the label strip and the transport wheel in the introduction phase a certain relative movement must be possible because the driver teeth should not penetrate through the label strip until they have moved along the strip up to one of the transport cuts. Nevertheless, the strip should be advanced without interruption after the initial introduction into the gap as well so that it is not necessary to push it on by hand in the course of the operating cycles to be carried out.

The invention is based on the problem of providing a means of the type set forth at the beginning with the aid of which the label strip can be introduced rapidly and simply into the labelling apparatus without having to apply a high transport force for this purpose and it is simultaneously ensured that the form-locking engagement of the transport wheel into the label strip takes place at the points provided therefor.

This problem is solved according to the invention in that the distance of the inner surface of the cover from the peripheral face of the transport wheel in a first region immediately adjoining the entrance point is so dimensioned that the driver teeth on rotation of the transport wheel exert a frictional force on the label strip inserted at the entrance point between the peripheral face of the transport wheel and the cover, in a second region adjoining the first region is dimensioned so that the label strip is not deformed by the driver teeth and in a third region extending from the second region up to the exit point is so dimensioned that the driver teeth penetrate into the groove of the inner surface and penetrate through the label strip.

In the apparatus according to the invention the label strip on initial insertion into the gap between the cover and the transport wheel is entrained by friction, this requiring a relatively low entraining force because the strip is hardly deformed by the driver teeth in this region of the cover. In the second region the label strip is further advanced without deformation in the gap between the cover and the transport wheel so that no additional force apart from the force to be applied for the frictional entraining is necessary. Finally, in the third region the driver teeth come into contact with the label strip, the driver teeth in this region penetrating through the transport cuts in the carrier strip so that a form-locking engagement results which ensures the desired exact transport through one label length each time.

Advantageous further developments of the invention are characterized in the subsidiary claims.

Figure 2A:
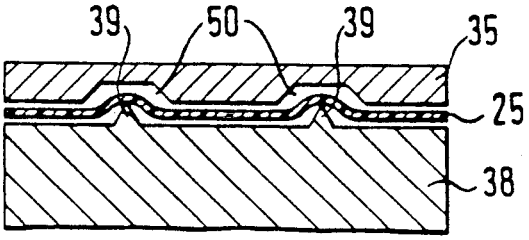
Figure 2B:
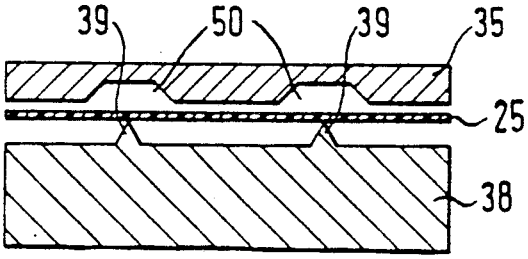
Figure 2C:
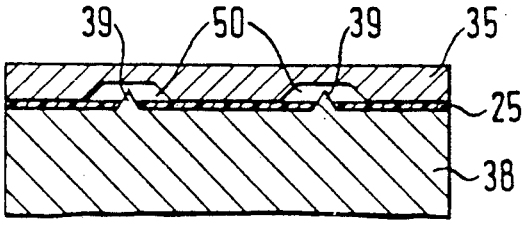

The invention will now be explained by way of example with the aid of the drawings, wherein:

FIG. 1 is a schematic representation of a labelling machine having the means according to the invention and FIGS. 2*a*, 2*b* and 2*c* show schematic sections along the lines A—A, B—B and C—C respectively in FIG. 1.

The label printing and dispensing apparatus 10 shown schematically in FIG. 1 permits the imprinting, dispensing and attaching of self-adhering or pressure-sensitive labels disposed on a carrier strip. If however the self-adhering labels are already provided with imprints the components provided for the imprinting may also be omitted. However, with the apparatus labels can also be handled which are not disposed on a carrier strip but form a continuous label strip of which the labels are imprinted in the apparatus and then, still connected together, dispensed from the apparatus. These imprinted labels are then separated by hand and applied to the articles for sale.

The apparatus 10 comprises a housing 12 shown in its outlines and provided at its end lying on the right in FIG. 1 with a grip 14. An operating lever 16 is mounted in the housing pivotally about a pin 18. The operating lever 16 is held in the rest position shown in FIG. 1 by a spring 20 tensioned between said lever and the grip 14. The operating lever 16 carries a printing mechanism 22 at its end lying on the left in FIG. 1.

The self-adhering labels to be imprinted, dispensed and applied with the aid of the apparatus 10 are initially disposed on a carrier strip or tape 24 which is coiled to a supply roll 26 which is inserted into the housing 12. In the ready-to-use state the carrier strip with the self-adhering labels stuck thereto first runs over a printing table 28 which can be part of a housing bottom 30. At the front end of the printing table 28 the carrier strip is deflected in an acute angle about a dispensing edge 32 and it then runs along the housing bottom 30 rearwardly up to an introduction slot 34. Said introduction slot 34 is defined on the left side lying in FIG. 1 by a deflection roller 36 which deflects the carrier strip 24 in a direction running tangentially to a transport wheel 38 rotatable about an axis 33. The other side of the introduction slot 34 is defined by a cover 35 which surrounds the transport wheel 38 over an angle of about 180° and which is connected to the housing bottom 30 pivotally about a pin 37. The construction and function of the transport roll 38 in its cooperation with the cover 35 will be explained in more detail in connection with the description of an operating cycle of the labelling apparatus 10.

To operate the labelling apparatus 10 the operator pulls the operating lever 16 against the action of the spring 20 in the direction towards the grip 14 and as a result the printing mechanism 22 is lowered in the direction towards the self-adhering label disposed on the printing table 28 and produces the desired imprint on said label. Simultaneously with the pulling of the operating lever 16 a thrust rod 40 coupled thereto has moved to the right in FIG. 1 to such an extent that its front end lying on the left in FIG. 1 is retracted to such an extent that it comes to lie behind a stud 44 attached to the transport wheel 38. As can be seen, six such studs are disposed on the side wall of the transport wheel 38 visible in FIG. 1. By a detent mechanism, not shown, the transport wheel 38 is held in the position shown. Said detent mechanism prevents rotation of the transport wheel 38 anticlockwise but permits clockwise rotation.

If now the operating lever 16 is released it is urged by the spring 20 away from the grip 14 and returns to the rest position shown in FIG. 1. When this is done the printing mechanism 22 is lifted off the printing table and at the same time the carrier strip 24 is transported through a distance corresponding to one label length. This is done as follows:

On return of the operating lever 16 to the rest position illustrated in FIG. 1 the front end 42 of the thrust rod 40 engages the pin 44 and thereby rotates the transport wheel 38 until the pin 44 assumes the position of the pin 44*a*. At the peripheral face of the transport wheel 38 driver teeth 39 are disposed which engage into transport incisions or cuts formed in the carrier strip so that the transport wheel 38 on rotation in the clockwise direction entrains the carrier strip. The movement of the transport wheel 38 is here so dimensioned that the carrier strip 24 is entrained exactly through the distance corresponding to a label length. On this movement the carrier strip 24 is pulled round the dispensing edge 32 and as a result a self-adhering label stuck thereto detaches and moves into a position beneath an application roller 46. The self-adhering label 48 illustrated in FIG. 1 assumes this position beneath the application roller 46. By rolling the application roller 46 over an article the self-adhering label 48 is stuck to said article.

By repeated pulling of the operating lever 16 one self-adhering label after the other can be brought into the position of the self-adhering label 48 and then applied to an article. Via its coupling to the transport wheel 38 the thrust rod 40 ensures stepwise advancing of the carrier strip 24.

To make the labelling machine 10 ready to use firstly the label strip 25 consisting of the carrier strip 24 and the self-adhering labels 48 adhering thereto must be inserted. For this purpose a length of the label strip 25 is unwound from the supply roll 26 and pushed from above in the direction towards the dispensing edge 32 until it projects in front of the dispensing edge 32. The strip is then pushed into the introduction slot 34 which as can be seen in FIG. 1 narrows to a gap defined on the one side by the cover 35 and on the other side by the transport wheel 38.

As can be seen in FIGS. 2*a*, 2*b* and 2*c* the cover 35 comprises at its inner surface grooves which are associated with the path along which the driver teeth 39 on the transport wheel 38 move on rotation thereof. Immediately adjoining the entrance point at which the strip moves into the gap between the cover 35 and the transport wheel 38 the distance between the inner surface of the cover 35 and the peripheral face of the transport wheel 38 is so dimensioned that the driver teeth 39 on rotation of the transport wheel exert a frictional force on the strip which is large enough for the strip 25 to be entrained by the transport wheel 38 when the latter rotates. A penetration of the driver teeth 39 into the strip 25 does not however take place because for this purpose a force would have to be exerted which is greater than a frictional force merely effecting the entraining. Following said first region of the gap between the cover 35 and the transport wheel 38, which extends over about ⅓ of the total length of the cover 35 in the peripheral direction of the transport wheel 38, there is a second region (FIG. 2*b*) in which the distance between the cover 35 and the transport wheel 38 is so large that only a wiping contact takes place between the driver teeth 39 and the label strip and the label strip is thus not deformed. The label strip can thus move on in this manner unrestricted in this region so that no additional force greater than the previously mentioned frictional force need be applied. This second region also extends over about ⅓ of the total length of the cover 35.

In a third region (FIG. 2*c*) of the gap between the cover 35 and the transport wheel 38 the distance between the inner peripheral surface of the cover and the outer face of the transport wheel 38 is so small that the driver teeth 39 penetrate far into the grooves 50 of the inner surface of the cover 35. This leads necessarily to penetration of the driver teeth through the label strip so that a form-locking engagement results. Due to the relative mobility between the label strip and the transport wheel 38 in the two first regions of the gap the driver teeth 39 continue to slide along the label strip at the start of the third region until they meet the transport cuts at which they can very easily penetrate through the label strip. For this reason the penetration takes place with great certainty at the points provided therefor and it is therefore ensured that the label strip is always transported so that one self-adhering label after the other comes to lie in the correct position on the printing table 28.

In FIG. 2*a* it can be seen how the distance between the inner peripheral surface of the cover 35 and the peripheral face of the transport wheel 38 is dimensioned in the first region. Although the label strip is slightly deformed in this region no penetration of the driver teeth 39 through the label strip 25 takes place but only a frictional entraining of the label strip 25 on rotation of the transport wheel 38.

FIG. 2*b* shows that in the second region no deformation of the label strip 25 by the driver teeth takes place whereas in FIG. 2*c* it can be seen that the driver teeth 39 have penetrated through the label strip.

It is pointed out that on insertion of the label strip into the apparatus self-adhering labels 48 are still present on the carrier strip. It is only when several operating cycles have been carried out and accordingly several self-adhering labels 48 imprinted and dispensed that the carrier strip alone is guided round the transport wheel 38. It is precisely because on insertion of the label strip into the entrance slot 34 the carrier strip 24 is introduced with self-adhering labels 48 stuck thereto that the configuration of the gap between the cover 35 and the transport wheel 38 is favourable because the relatively stiff label strip 25 is reliably engaged by the transport wheel 38 and is transported without any unnecessary increasing of the force application up to the point at which the penetration of the driver teeth 39 takes place to establish the form-locking engagement.

In label strips 25 usual today the joint thickness of the carrier strip and the self-adhesive labels may be 0.15 mm. The driver teeth 39 preferably penetrate in the first region of the gap between the cover 35 and the transport wheel 38 about 0.4 to 0.5 mm into the grooves 50 at the inner surface of the cover 38. This leads to the slight deformation of the label strip 25 apparent in FIG. 2*a* without penetration of the driver teeth 39 into the label strip 25 being able to take place.

To make the interior of the labelling apparatus 10 accessible the housing bottom 30 is connected to the housing 12 pivotally about a pin 52. The housing bottom 30 can thereby be pivoted downwardly in the illustration of FIG. 1, the transport wheel 38 with the cover 35 simultaneously being pivoted out of the housing 12 because said parts are connected to the housing bottom 30. If necessary for cleaning purposes the cover 35 can be swung away from the transport wheel 38 by pivoting about the pin 37. This may for example be necessary when residues of adhesive have stuck to the peripheral face of the transport wheel 38 and have to be removed again.

I claim:

1. Means for supplying a label strip to the peripheral face of a transport wheel which is provided with radially projecting driver teeth, mounted on a label printing and/or label dispensing apparatus, rotatably mounted about an axis and engages the label strip by penetration of the driver teeth into transport cuts in the label strip and transports said strip from an entrance point to an exit point in each case through a distance equal to the length of the labels, the pitch of the driver teeth in the peripheral direction of the transport wheel being slightly greater than the pitch of the transport cuts in the label strip in the longitudinal direction thereof, the transport wheel being surrounded between the entrance point and the exit point by a cover which extends in the peripheral direction of the transport wheel and which in its inner face associated with the path along which the driver teeth move on rotation of a transport wheel is provided with at least one groove, characterized in that the distance of the inner surface of the cover from the peripheral face of the transport wheel in a first region immediately adjoining the entrance point is so dimensioned that the driver teeth on rotation of the transport wheel exert a frictional force on the label strip inserted at the entrance point between the peripheral face of the transport wheel and the cover, in a second region adjoining the first region is dimensioned so that the label strip is not deformed by the driver teeth and in a third region extending from the second region up to the exit point is so dimensioned that the driver teeth penetrate into the groove of the inner face and penetrate through the label strip.

2. Means according to claim 1, characterized in that with a label strip having a joint thickness of the carrier strip and the self-adhering labels of 0.15 mm the driver teeth penetrate in the first region 0.4 to 0.5 mm into the grooves on the inner surface of the cover.

3. Means according to claim 1 or 2, characterized in that the transport wheel is rotatably mounted in a bottom which is adapted to be folded out of the label printing and dispensing apparatus and that the cover for exposing the peripheral face of the transport wheel in the region of the entrance point is pivotally mounted in the bottom about a pin parallel to the axis of the transport wheel.

* * * * *